US005791625A

United States Patent [19]

Orser

[11] Patent Number: 5,791,625

[45] Date of Patent: Aug. 11, 1998

[54] ADJUSTABLE BRACKET FOR SAWTOOTH PICTURE HANGER

[76] Inventor: Garry Orser, P.O. Box 163, Hartland, New Brunswick, Canada, E0J 1N0

[21] Appl. No.: 775,580

[22] Filed: Dec. 31, 1996

[51] Int. Cl.[6] ..... A47G 1/24

[52] U.S. Cl. ..... 248/495; 248/544

[58] Field of Search ..... 248/495, 494, 248/292.14, 312.1, 489, 475.1, 544, 291.1, 294.1, 299.1

[56] References Cited

U.S. PATENT DOCUMENTS

| | | | |
|---|---|---|---|
| 406,623 | 7/1889 | Brinkerhoff . | |
| 1,025,964 | 5/1912 | Costuma . | |
| 2,488,925 | 11/1949 | Miller . | |
| 2,495,477 | 1/1950 | Raitt . | |
| 2,496,990 | 2/1950 | Downing . | |
| 2,657,887 | 11/1953 | White | 248/495 |
| 2,709,056 | 5/1955 | Jacquet . | |
| 2,877,972 | 3/1959 | Sutton et al. . | |
| 2,965,339 | 12/1960 | Denton . | |
| 3,042,353 | 7/1962 | O'Mara | 248/544 |
| 3,051,422 | 8/1962 | Crump et al. | 248/299.1 X |
| 3,226,065 | 12/1965 | Smith . | |
| 3,838,842 | 10/1974 | McCracken . | |
| 4,069,998 | 1/1978 | Rytting . | |
| 4,566,665 | 1/1986 | Rynearson . | |
| 4,804,161 | 2/1989 | Wallo | 248/544 |
| 5,069,412 | 12/1991 | Jacob . | |

*Primary Examiner*—Leslie A. Braun
*Assistant Examiner*—Tan Le

[57] ABSTRACT

An adjustable bracket for sawtooth picture hanger includes a base element adapted to be affixed to a wall, and an adjustable element having a ledge for supporting the hanger, a vertical tab extending upward from the ledge, over which the hanger is placed, and a horizontal tab received in the base element. A machine screw or other adjustable-tension fastener connects the adjustable element to the base element. At least one of the tab and the fastener has widthwise lost motion to permit the adjustable element to be tilted somewhat with respect to the base element, while the fastener is not tightened, to reorient the picture.

4 Claims, 1 Drawing Sheet

ADJUSTABLE BRACKET FOR SAWTOOTH PICTURE HANGER

BACKGROUND OF THE INVENTION

This invention relates to the art of supports and more particularly to an adjustable bracket for supporting a picture having a sawtooth picture hanger.

The familiar difficulties of the ostensibly simple task of hanging a picture or painting exactly horizontal on a wall have led to many inventive brackets and other hardware for hanging pictures. The annoyance of those people having a talent for spotting—and being bothered by—out of plumb pictures would be ameliorated by a bracket or support which permitted deliberate adjustment, but resisted subsequent movement of the picture. An ideal bracket could be finely adjusted, once, and would thereafter lock the picture in the orientation selected, keeping it from tilting even if accidentally bumped. A number of adjustable prior brackets, while theoretically sound, are so complicated that their cost prohibits successful mass marketing.

SUMMARY OF THE INVENTION

An object of the invention is to provide a picture hanging bracket which can be inexpensively manufactured and distributed, yet is sufficiently robust to hang framed pictures of at least moderate size, and will resist or prevent tilting of a picture despite occasional jarring and touching.

These and other objects are attained by an adjustable bracket for sawtooth picture hanger, as described below. The bracket includes a base element adapted to be affixed to a wall, and an adjustable element having a ledge for supporting the hanger, a vertical tab extending upward from the ledge, over which the hanger is placed, and a horizontal tab received in the base element. A machine screw or other adjustable-tension fastener connects the adjustable element to the base element. Either the tab and the fastener has widthwise lost motion to permit the adjustable element to be tilted somewhat with respect to the base element, while the fastener is not tightened, to reorient the picture.

DESCRIPTION OF THE PREFERRED EMBODIMENT

Figure 1:
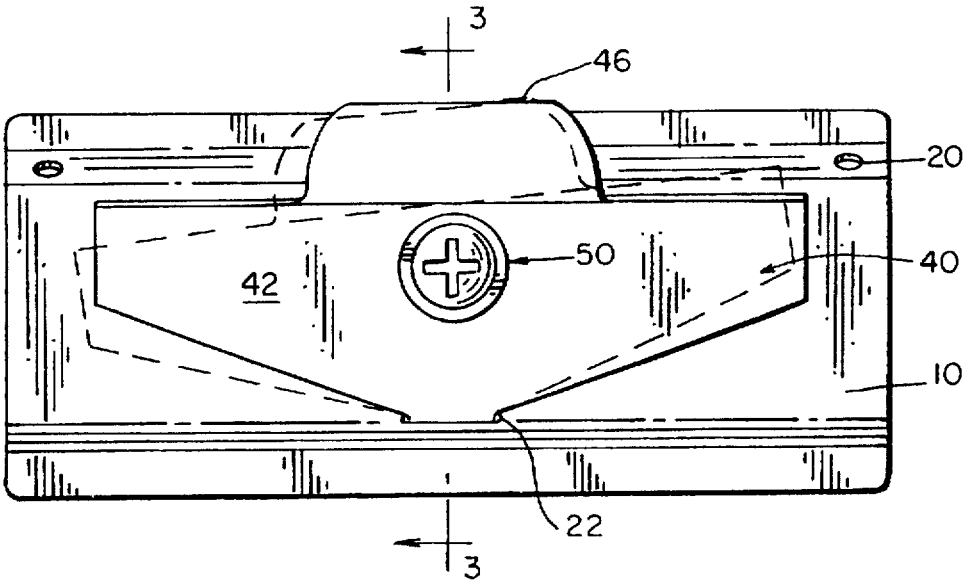
FIG. 1 is a front elevational view of a bracket assembly embodying the invention.

An adjustable bracket for a sawtooth picture hanger is shown in the drawings. The bracket is actually an assembly comprising a base element 10, intended to be fixed to a wall, and an adjustable element 40 which is connected to the base element by an adjustable-tension fastener 50. The preferred fastener comprises a machine screw 52, a flat washer 54, and a lock nut 56, best seen in FIG. 3. Other fasteners capable of providing adjust tension may prove suitable in the alternative, or in addition.

Figure 2:
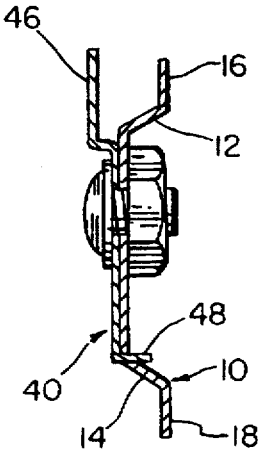
FIG. 2 is a section thereof taken on the vertical center plane 2—2 in FIG. 1.

The base element 10 is formed of sheet metal, and is of uniform cross-section on a vertical plane, as seen in FIG. 2.

The upper and lower edges 12,14 are bent out of the plane of the element at about 60°, about line parallel to and equidistant from the respective top and bottom edges. The tips 16,18 of the flanges are bent back to parallel with the main portion of the base element, so that they will rest flat against a wall surface. At least two holes 20 are formed in the upper flange, for receiving nails or brads that are driven into the wall, as suggested by FIG. 3. A rectangular slot 22 is formed in the base element astride the vertical center plane, and an elongated hole 24 is provided directly above the slot, for receiving the fastener 50. The size and shape of the hole may be changed from that shown, to accommodate the particular fastener used. The flanges, holes and slot may be formed by conventional punching operations.

The adjustable member 40 has a vertical main portion 42, a horizontal ledge 44, and a vertical tab 46 extending upward from the ledge, parallel to but offset from the main portion. The tab is slightly narrower than the inside dimension of the sawtooth hanger for which it is intended, and the height of the tab is somewhat taller than the vertical dimension of the sawtooth hanger. The bottom edge of the adjustable element may be beveled at a modest dihedral angle as illustrated, but this is for aesthetic rather than utilitarian purposes. In any event, there is a horizontal tab 48, extending rearward at the center bottom of the main portion. The horizontal tab is inserted into the slot 22 when the parts are assembled.

Until the fastener is tightened, the adjustable element can be oscillated somewhat (about 5° in either direction from parallel to the base element). To make such movement possible, one or both of the slot 22 and the hole 24 must be, widthwise, somewhat larger than the corresponding tab 48 or screw 52. I presently prefer to provide all or most of the free play at the fastener, making the horizontal tab a close sliding fit within the slot 22. This arrangement better resists loosening of the parts if the screw is undertorqued.

While the bracket described is specifically intended for use with pictures having sawtooth hangers, it should be noted that the bracket will also support a picture wire. In the latter situation, the adjustability advantage of the invention is lost, but not having to change the bracket in order to change the picture type is a great advantage.

Figure 3:
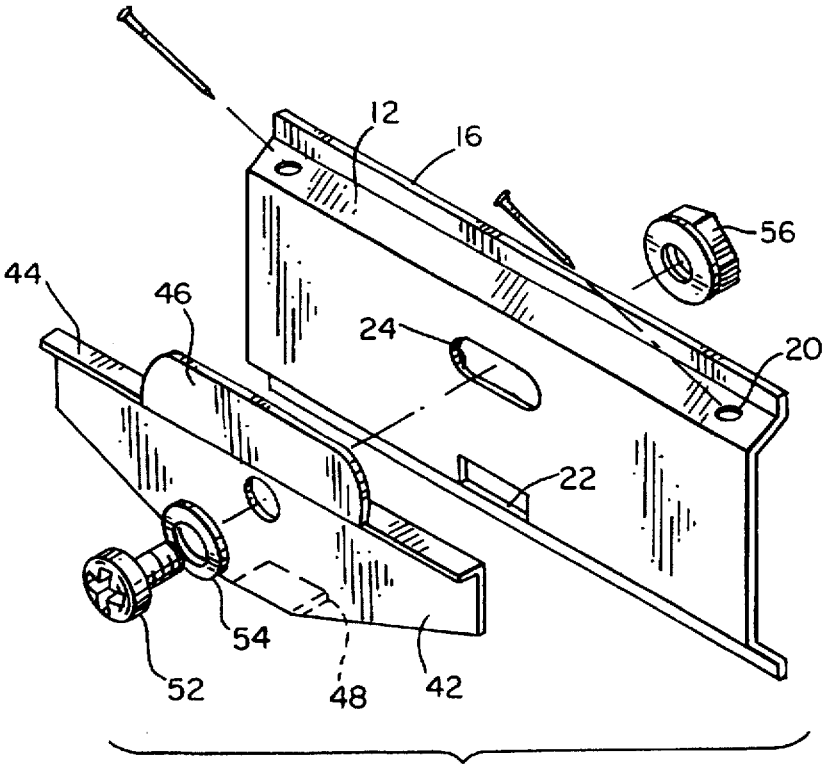
FIG. 3 is an exploded isometric view thereof, showing the bracket assembly associated with a framed painting.

FIG. 3 shows how the bracket is assembled, and how it and the picture are hung on a wall. The installation steps are, first, to preassemble the adjustable and base elements, without tightening the fastener, then to nail or otherwise affix the base element securely to the wall at the desired installation height, then to place the sawtooth hanger of the picture over the vertical tab and check the picture for alignment. The adjustable member is adjusted (tilted, as suggested by the broken lines in FIG. 1) and readjusted as necessary until the picture orientation is correct. Then the fastener is fully tightened, and the picture re-hung. As long as the sawtooth hanger was installed properly on the picture frame (above the center of gravity of the frame), the broad contact line between the ledge and the hanger will prevent the picture from tilting on the wall.

The material presently preferred for both the base element and the adjustable element is a 24–28 gauge metal, preferably steel. Aluminum or even plastic materials may prove suitable for smaller pictures. The principles of the invention would apply if the bracket were scaled up to support large items, but it is understood that most large pictures do not have sawtooth or equivalent hangers.

Since the invention is subject to modifications and variations, it is intended that the foregoing description and the accompanying drawings shall be interpreted as only illustrative of the invention defined by the following claims.

I claim:

1. An adjustable bracket assembly for supporting a picture, having a sawtooth picture hanger, on a wall, said assembly comprising a base element adapted to be affixed to the wall, an adjustable element having a ledge for supporting the hanger, a vertical tab extending upward from the ledge, over which the hanger may be placed, and a horizontal tab received in an opening slot in said base element, and an adjustable-tension fastener interconnecting the adjustable element and the base element, at least one of said tab and said fastener having widthwise lost motion to permit the adjustable element to be tilted somewhat with respect to the base element, while the fastener is not tightened, to reorient the picture.

2. The invention of claim 1, wherein the base element has a pair of parallel flanges top and bottom, the top flange having holes for receiving nails for securing the base element to a wall.

3. The invention of claim 1, wherein the ledge on the adjustable element is wider than the vertical tab.

4. The invention of claim 1, wherein said fastener comprises a machine screw and a lock nut.

* * * * *